US006017241A

United States Patent [19]

Komai

[11] Patent Number: 6,017,241

[45] Date of Patent: Jan. 25, 2000

[54] AISLE LIGHTING LAMPHOLDER

[75] Inventor: Neil M. Komai, Temple City, Calif.

[73] Assignee: Tivoli Industries, Inc., Santa Ana, Calif.

[21] Appl. No.: 09/013,664

[22] Filed: Jan. 26, 1998

[51] Int. Cl.[7] ..... H01R 4/24

[52] U.S. Cl. ..... 439/419; 439/409

[58] Field of Search ..... 439/419, 414, 439/417, 404, 409, 395

[56] References Cited

U.S. PATENT DOCUMENTS

| | | | |
|---|---|---|---|
| 3,456,104 | 7/1969 | Williams | 439/409 |
| 4,653,829 | 3/1987 | LaMont | 439/409 |
| 5,045,981 | 9/1991 | Nagano | 362/219 |
| 5,330,368 | 7/1994 | Tsuruzono | 439/419 |
| 5,460,539 | 10/1995 | Gallone | 439/417 |
| 5,499,931 | 3/1996 | Yang | 439/409 |
| 5,647,761 | 7/1997 | Kaminski | 439/419 |

OTHER PUBLICATIONS

"Mouser Catalog," Manual 590, pp. 155–156, exp. Jul. 31, 1997.

*Primary Examiner*—Paula Bradley
*Assistant Examiner*—Tho D. Ta
*Attorney, Agent, or Firm*—Price, Gess & Ubell

[57] ABSTRACT

A lampholder structure employing oppositely disposed bed and cover sections hingedly mounted so as to open to permit insertion of first and second electrical feed wires in respective recesses of the structure. Clamping of the bed and cover sections together captures the feed wires and causes interconnection of a lighting device and an optional resistor with the feed wires by forcing a plurality of interior contact elements to penetrate into the feed wires.

15 Claims, 3 Drawing Sheets

40
37
38
25
25
42
31
33
36
16
15
29
23
21
35
34

81
83

27
17
19
13
52
53
68
66
67
63
27
61
54
56
51

AISLE LIGHTING LAMPHOLDER

BACKGROUND OF THE INVENTION

1. Field of the Invention

The present invention relates to lighting apparatus and more particularly to improved lampholder structures for aisle lighting apparatus.

2. Description of Related Art

Low-voltage string-lighting systems have been used extensively for decorating both private homes and commercial establishments. String-lighting systems are ideal for decoration because they can be displayed in various places and in nearly every imaginable form. For example, low-voltage string-lighting systems are often used to decorate walls, floors, ceilings, and staircases, of restaurants, nightclubs, hotels, and movie theaters. One of the more common commercial uses of string-lighting systems is aisle lighting in movie theatres, where a string of lights is placed down each side of an aisle.

A typical low-voltage string-lighting system, such as those used for aisle lighting, includes a power line having multiple light fixtures attached thereto (hereinafter a "light string"), an external housing made of a durable material such as vinyl or aluminum, and an external covering which is translucent and generally fits within the housing. The external housing is typically manufactured by an extrusion process and is commonly referred to in the lighting industry as a floor extrusion.

A single light string in a common string-lighting system may include dozens of individual light bulbs. Assembly of such lamp strings and replacement of burned out lamps is thus highly labor intensive and has led to efforts to simplify lampholder structures to reduce part counts and speed light string assembly. A result of such efforts is the lampholder structure disclosed in U.S. Pat. No. 5,045,981 assigned to the present assignee. That structure includes a lamp socket which slideably mounts onto guide rails of a carriage component. The carriage component includes lateral side slots which receive respective conducting wires and further slideably inserts into a base component. Insertion of the carriage component into the base component forces electrical contact elements on the side of the carriage to penetrate into and establish electrical contact with the conducting wires.

Although providing considerable improvement, assembly of the foregoing structure still requires a considerable number of intricate manual manipulations of its several parts. Additionally, the structure is not ideally suited for use with light emitting diodes (LED's), which are presently coming into use because of their lower power requirements and longer life.

OBJECTS AND SUMMARY OF THE INVENTION

Accordingly, it is an object of the invention to improve lampholder structures;

It is a more particular object to improve lampholder structures employed in light string applications;

It is another object of the invention to provide lampholder structures particularly suited to hold LED's;

It is another object of the invention to provide lampholder structures of relatively low part count and which require relatively few manipulations to assemble.

These and other objects and advantages are achieved according to the invention by providing a lampholder structure comprising a cover section having an undersurface and including means for receiving a lighting device, and a bed section including first and second recesses in a top surface thereof for receiving respective first and second feed wires. Contact means located in at least one of the cover and bed sections includes a piercing portion positioned to pierce the insulation layer of a first of the feed wires and establish electrical contact to the lighting device. In the preferred embodiments, the cover and bed sections are preferably hingedly attached together at one edge.

According to one aspect of a first preferred embodiment, a recess means is additionally provided within the structure for mounting a resistor having first and second leads, and an electrically conductive contact element is positioned to contact a first lead of the resistor and to pierce and establish electrical contact with a second of the feed wires. The first preferred embodiment further includes another electrically conductive contact element positioned to contact the second lead of the resistor and an electrical contact of the lighting device.

According to a second preferred embodiment, the cover section includes first and second openings into respective first and second paths to respective first and second lead wires. The first and second openings each include an electrical contact element having a piercing portion of a length selected to extend into a respective one of the paths and to pierce the insulation layer of a respective one of the feed wires so as to establish electrical contact thereto.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide lampholders which are particularly efficient in operation and easily manufactured and assembled.

Figure 1:
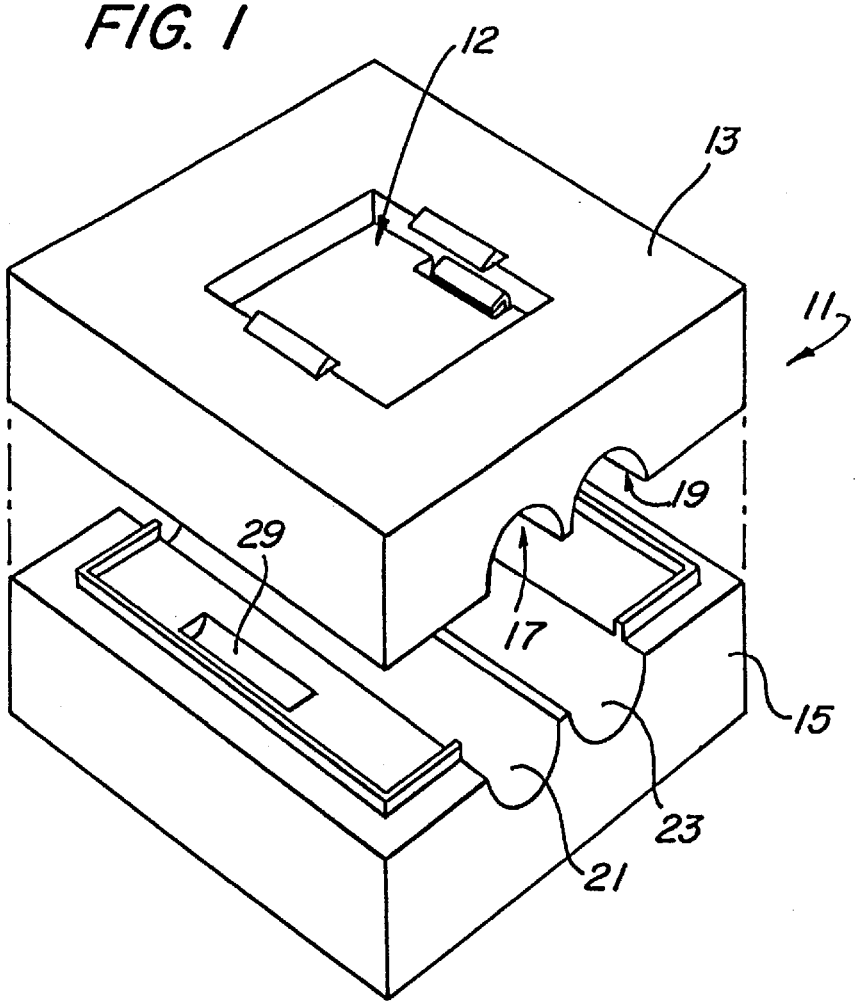
FIG. 1 is a perspective view illustrating the general layout of a first preferred lampholder embodiment according to the invention.

FIG. 1 illustrates general features of a lampholder 11 according to a first embodiment of the invention. The lampholder 11 employs a generally rectangular-shaped bed 15 onto which a top or cover 13 is mounted. The method of mounting the cover 13 to the bed 15 preferably includes a living hinge structure, as later described, or other structure permitting the bed 15 and cover 13 to be closed or clamped together. The cover 13 includes a recess 12 for surface mounting an LED circuit package, as well as first and second semicircular upper conductor channel recesses 17, 19. The underlying bed 15 employs oppositely disposed semicircular conductor channel recesses 21, 23 and further includes a resistor cavity or a recess 29.

As will now be described in connection with FIGS. 2–5, suitable contact elements are located in the bed 15 and cover 13 in order to appropriately interconnect a resistor located in the resistor cavity 29 and an LED device located in the recess 12 to electrical power supplied by conductors located in the channels formed by the channel recesses 17, 19; 21, 23. The cover 13 and bed 15 are preferably fabricated of a suitable plastic such that a plastic "clam shell" device results wherein the feed wires may simply be inserted into the channels and the device half shells closed together in order to create the desired electrical lighting circuit.

Figure 2:
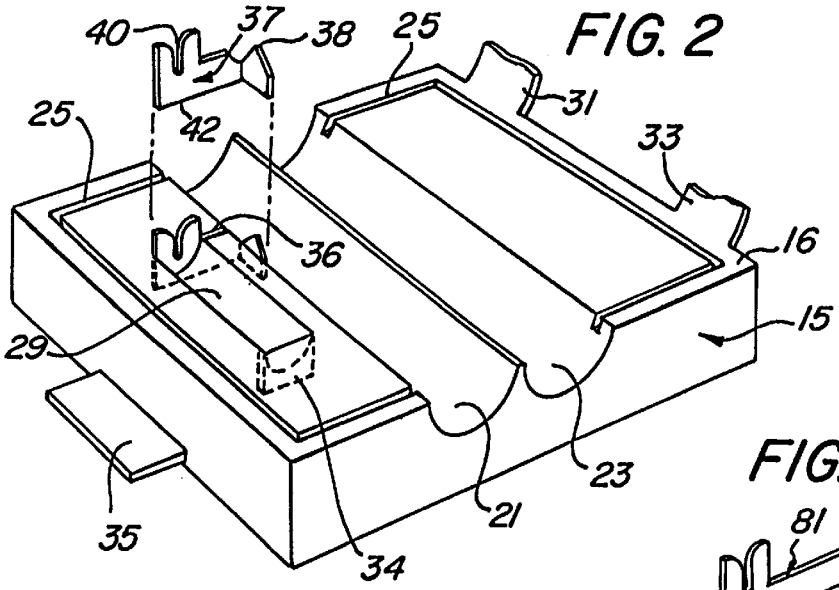
FIG. 2 is a perspective view of a bed component according to the first embodiment.
Figure 3:
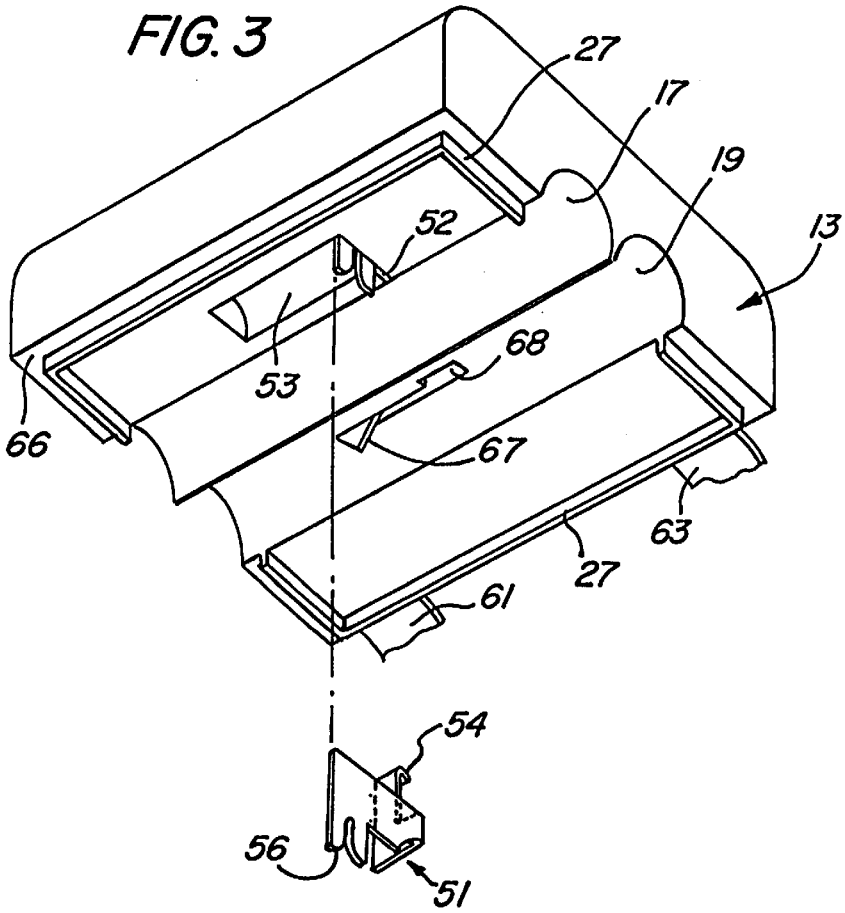
FIG. 3 is a perspective of a cover component according to the first embodiment.

FIGS. 2 and 3 illustrate further details of the cover and bed components 13, 15. In particular, the bed 15 includes grooves 25 at the peripheral edges of the top surface 16 thereof for mating with complimentary lips 27 on the mating undersurface 66 of the cover 13 in order to provide a seal against liquid intrusion. As may be seen, this lip/groove seal structure terminates at the edges of the respective channel recesses 21, 23. Cooperating pairs of living hinge elements 31, 61; 33, 63 are provided at one edge of the bed 15 in order to hingeably attach the cover 13 to the bed 15. Optional ears or other engagement means 35 may be applied to the bed 15 or cover 13 in order to engage cooperating features of aisle lighting extrusions. Such ears 35 may be scored at their intersection with the cover 13 or bed 15 in order that they may snap off for other applications.

The bed 15 further includes a vertical slot 34 for receiving the lower contact portion 56 of a top resistor contact 51 (FIG. 3) and a second vertical slot 36 for receiving the bottom edge 42 of a contact element 37. The contact element 37 includes a slotted contact 40 for receiving one pin of a discrete resistor and a second spade contact 38 for piercing the insulation layer of a first feed wire 73 (FIG. 4) located in the lower channel recess 21 so as to establish electrical contact with the electrical conductor portion of the feed wire 73. In the particular embodiment of FIG. 2, the spade contact 38 is shown bent at a right angle to the portion bearing contact 40. Contacts configured like contact 40 are disclosed, for example, in the Mouser catalog, pp. 155–156, manual 590, exp. Jul. 31, 1997, where they are referenced as Insulation Displacement Connectors. Various other embodiments of contacts applicable in lampholders configured according to the invention will be apparent to those skilled in the art, for example, contacts 81 or 83 as shown in FIG. 5. Such contacts are preferably retained in place by press-fit, barbs, snap-in arrangements or similar mechanisms which permit them to be securely retained as well as inserted manually or by suitable tools.

The view of FIG. 3 illustrates the upper half 53 of the resistor cavity, as well as a slot 52 for receiving the top resistor contact 51. The top resistor contact 51 includes a split contact 56 for contacting a second of the resistor leads, as well as a contact portion 54, which extends into the surface mount LED recess 12. FIG. 3 further illustrates a spade contact 67 mounted in a slot 68. The contact 67 bites into a second feed wire 75 (FIG. 4) located in conductor channel recess 23. A folded down tab portion of the contact 67 extends through a rectangular opening in the slot 68 and into the surface mount LED recess 12 for establishing electrical contact with the second lead or contact of the LED surface mount circuit 77.

Figure 4:
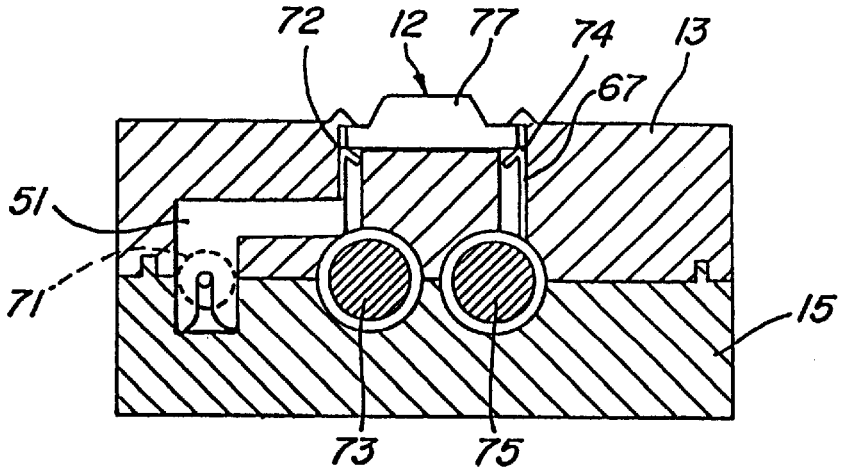
FIG. 4 is an end view of the components of FIGS. 2 and 3 as assembled.
Figure 5:
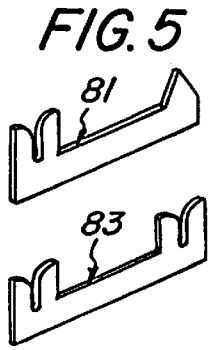
FIG. 5 illustrates alternative contact embodiments.

FIG. 4 particularly illustrates a resistor 71 and feed wires 73, 75 in place in their respective recesses in the bed/cover combination 13, 15. Contact 51 is shown engaging one lead or pin of the resistor 71, while contact 67 is shown piercing the insulation of the second feed wire 75 and engaging its conductor portion. The contacts 51, 67 are further illustrated as having upper prongs 72, 74. Such prongs 72, 74 may snappably engage appropriate contact portions of an LED package 77. Various other snap-in contact arrangements known to those skilled in the art can also be used for providing a snap-in or other convenient insertion and interconnection of LED component 77. The feed wires 73, 75 may conveniently be speaker wire or 18 to 22 gauge wire providing a 12 to 24 volt supply, which is reduced to a suitable 2½ volt LED activating voltage by the resistor 71.

FIGS. 6–10 illustrate an advantageous lampholder embodiment designed to mount either of two types of lamps: (1) a conventional incandescent lamp having two leads or pins or (2) an LED lamp device including an integral resistor and also having two leads or pins. Incorporation of the requisite resistor into the external LED package eliminates the necessity of creating a resistor cavity and the necessity to employ contacts such as 37, 51 for establishing contact between the LED device and the resistor.

Figure 6:
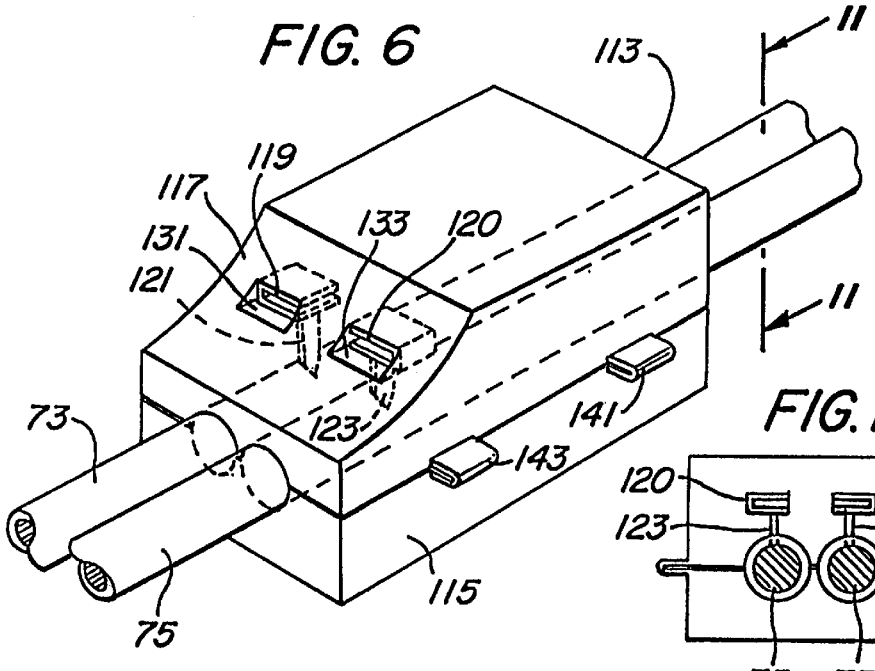
FIG. 6 is a perspective view of a second preferred lampholder embodiment.

FIG. 6 thus illustrates a simplified "clam shell" lampholder structure including a lower, substantially rectangular bed portion 115 and a cover portion 113 attached by respective hinge devices 141, 143. The cover portion 113 and bed 115 are preferably fabricated of a high temperature plastic, preferably not polycarbonate which has problems with various chemicals and soft drinks. It is preferable that the plastic be able to withstand the high temperatures of incandescent lamps without discoloration or embrittling. Use of incandescent lamps with rigid pins as opposed to flexible wire leads permits positioning the incandescent lamps away from the plastic lampholder structure in order to reduce the temperatures to which the structure is exposed. Those skilled in the art will appreciate that such rigid pins or flexible wire leads form points of electrical contact and are within the scope of the term "electrical contacts" as used herein.

Figure 7:
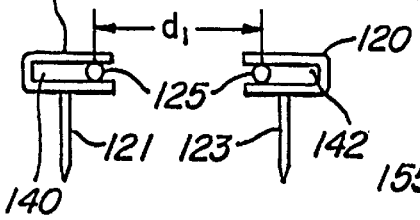
FIG. 7 is an end view of contact elements useful in the embodiment of FIG. 6.

The embodiment of FIG. 6 further includes first and second cavities 131, 133, formed in a recessed area 117 shown as an arcuate cutaway in the end of the cover 113. These cavities 131, 133 receive respective contact elements 119, 120, for establishing electrical contact to feed wires 73, 75. The contact elements 119, 120 are each of a horseshoe-shaped cross-section as shown in FIG. 7, providing respective interior lead receiving channels 140, 142, and respective electrically conductive spikes 121, 123. The channels 140, 142 permit the device 11 to accommodate lamps having various pin spacings $d_1$ between respective pins 125. FIG. 6 further illustrates the contacts 119, 120 in place with spikes 121, 123 piercing the insulation layer of respective feed wires 73, 75 so as to establish electrical contact with the conductor portions thereof. It may be noted that the "horseshoe" openings of the contacts 119, 120 will typically be relatively narrow in practice so as to accommodate contact pins of a very small diameter such as 0.020 inches.

Figure 11:
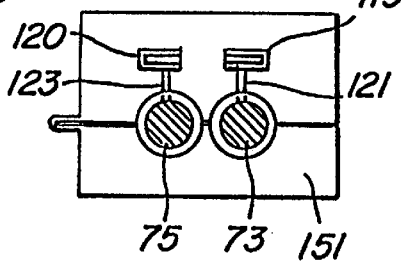
FIG. 11 is an end view of the lampholder taken at line 11—11 of FIG. 6.

As shown in FIG. 11, the back 151 of cover portion 113 is provided with two passageways which conform to the outer contours of the contacts 119, 120. These passageways extend all the way through the cover portion 113 to the first and second cavities 131, 133 and thereby permit the contacts 119, 120 to be pushed or otherwise inserted into place with their pin-receiving portions properly oriented in the cavities 131, 133.

Figure 8:
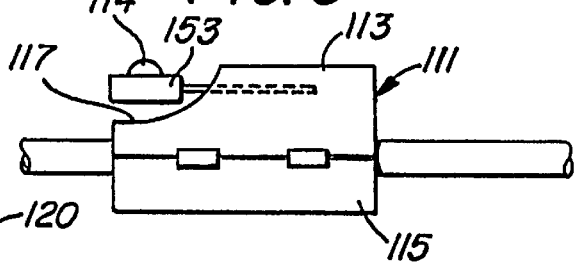
FIGS. 8–10 are side views of the lampholder of FIG. 5 with various lamps inserted therein.
Figure 9:
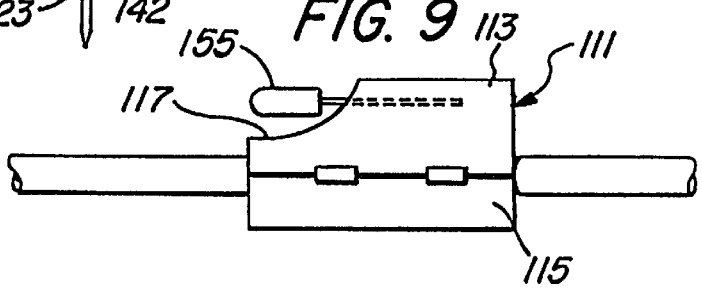
Figure 10:
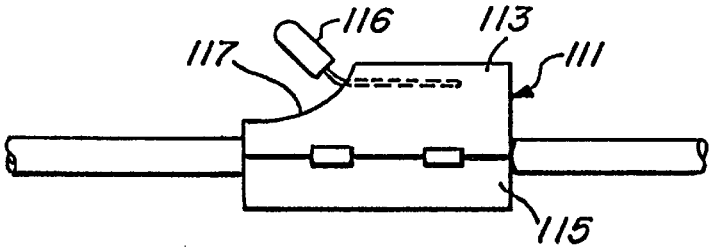

FIG. 8 shows a lighting device 153 employing an LED device 114 with an integral resistor inserted into the lampholder 111, with other details omitted for clarity. FIGS. 9 and 10 show similar insertions of incandescent bulbs 155, 116 into the lampholder 111. FIG. 10 particularly illustrates an angled positioning of an incandescent lamp 116 with respect to the horizontal. In all these embodiments, the arcuate cutaway 117 of the cover 113 reduces visual obstruction of the light source and the necessity to insert lamps at an angle.

The just disclosed preferred embodiments admit of a number of advantages. In particular, the preferred embodiments permit much easier assembly of lamp strings, while reducing the part count and assembly time of the lampholder structures themselves over various prior art approaches. Those skilled in the art will appreciate numerous nuances in fabrication of contact elements and other components of the preferred devices in view of the above disclosure. Therefore, it is to be understood that, within the scope of the appended claims, the invention may be practiced other than as specifically described above.

What is claimed is:

1. A lampholder structure comprising:

oppositely disposed bed and cover sections;

first and second recesses in said structure running longitudinally and parallel to each other, and shaped to receive longitudinal segments of first and second electrical feed wires;

first and second electrical contact elements disposed within said cover section, each said contact element carrying a spike extended perpendicular to said longitudinal direction;

first and second openings in said cover section, each opening providing access to a particular one of said contact elements;

an electric lamp having first and second parallel conductor prongs extending from said lamp into said first and second openings parallel to said longitudinal direction and engaging said first and second contact elements;

said lamp being slidably insertable into and removable from said structure by pushing-in or pulling-out said lamp in said longitudinal direction so as to respectively engage said prongs with said contact elements and to disengage said prongs from said contact elements; and means facilitating clamping of the bed and cover sections together so as to capture the first and second electrical feed wires and so as to cause electrical interconnection between each said said feed wires and a respective one of said spikes by forcing said spikes to penetrate into the feed wires.

2. The lampholder of claim 1 wherein each said prong is 0.020 inches in diameter.

3. The lampholder of claim 1 wherein said structure permits insertion of said lamp after said bed and cover sections have been clamped together to capture said feed wires.

4. The lampholder of claim 1 wherein said lamp comprises a light emitting diode device including an integrally formed resistor, said resistor thus being located outside of said lampholder structure.

5. The lampholder of claim 4 wherein each said prong is 0.020 inches in diameter.

6. The lampholder of claim 1 wherein said means further facilitates electrical interconnection of a resistor to form a circuit with said feed wires and said lighting device.

7. The lampholder of claim 6 wherein each said prong is 0.020 inches in diameter.

8. The lampholder of claim 1 wherein said means comprises at least one hinge pivotally joining the bed and cover sections.

9. The lampholder of claim 8 wherein each said prong is 0.020 inches in diameter.

10. A lampholder structure comprising:

oppositely disposed bed and cover sections;

first and second recesses in said structure running longitudinally and parallel to each other, and shaped to receive longitudinal segments of first and second electrical feed wires;

first and second electrical contact elements disposed within said cover section, each said contact element carrying a spike extended perpendicular to said longitudinal direction;

first and second openings in said cover section, each opening providing access to a particular one of said contact elements;

an electric lamp and first and second parallel conductor prongs extending from said lamp;

means including first and second longitudinal openings in said cover section enabling said prongs to be slidably insertable into and removable from said cover section by pushing-in or pulling-out said lamp in said longitudinal direction so as to respectively engage said prongs with said contact elements and disengage said prongs from said contact elements; and means for enabling clamping of the bed and cover sections together so as to capture the first and second electrical feed wires prior to insertion of said prongs into said openings and so as to cause electrical interconnection between each said feed wire and a respective one of said spikes by forcing said spikes to penetrate into the feed wires, thereafter permitting insertion and removal of said lamp via said openings.

11. The lampholder of claim 10 wherein said means for enabling clamping comprises at least one hinge pivotally joining the bed and cover sections.

12. The lampholder of claim 10 wherein each said prong is 0.020 inches in diameter.

13. The lampholder of claim 10 wherein each said prong is 0.020 inches in diameter.

14. The lampholder of claim 10 wherein said lamp device comprises a light emitting diode device including an integrally formed resistor, said resistor thus being located outside of said lampholder structure.

15. The lampholder of claim 14 wherein each said prong is 0.020 inches in diameter.

* * * * *